United States Patent [19]

Kotoh et al.

[11] Patent Number: 4,668,200

[45] Date of Patent: May 26, 1987

[54] LIFE BUOY WITH A RADAR RESPONDER

[75] Inventors: Keigo Kotoh; Nobuhiro Nakamura, both of Kawanishi, Japan

[73] Assignee: Mitsubishi Denki Kabushiki Kaisha, Tokyo, Japan

[21] Appl. No.: 878,506

[22] Filed: Jun. 23, 1986

Related U.S. Application Data

[63] Continuation of Ser. No. 571,185, Jan. 16, 1984, abandoned.

[30] Foreign Application Priority Data

Jan. 21, 1983 [JP] Japan ..... 58-8973
Mar. 10, 1983 [JP] Japan ..... 58-41066

[51] Int. Cl.[4] ..... B63B 22/08

[52] U.S. Cl. ..... 441/7; 441/6; 441/10; 441/11; 248/146; 248/318; 206/305

[58] Field of Search ..... 441/67, 10, 11, 12, 441/22, 32, 33; 367/3, 4; 206/305, 521, 523, 335; 343/709, 710; 211/74; 248/146, 176, 314

[56] References Cited

U.S. PATENT DOCUMENTS

| | | | |
|---|---|---|---|
| 351,208 | 10/1886 | Searles | 248/146 |
| 1,530,804 | 3/1925 | Anundi . | |
| 1,655,548 | 1/1928 | Honegger et al. . | |
| 2,189,587 | 2/1940 | Lallement | 248/146 |
| 3,081,466 | 3/1963 | Bailey | 367/4 |
| 3,207,317 | 9/1965 | Moore et al. | 248/314 |
| 3,451,079 | 6/1969 | Hagan | 441/7 |
| 3,506,841 | 4/1970 | Majkrzak | 441/11 |
| 4,194,246 | 3/1980 | Crist | 441/22 |
| 4,195,380 | 4/1980 | Higgs | 441/10 |
| 4,431,038 | 2/1984 | Rome | 248/314 |
| 4,489,116 | 12/1984 | Flood | 206/497 |

FOREIGN PATENT DOCUMENTS

| | | |
|---|---|---|
| 2156717 | 11/1971 | Fed. Rep. of Germany . |
| 2168374 | 1/1973 | France . |
| 2286049 | 9/1974 | France . |
| 55-154482 | 10/1980 | Japan . |
| 55-152483 | 10/1980 | Japan . |
| 1377593 | 1/1973 | United Kingdom . |

OTHER PUBLICATIONS

Weinstein, "How FM was used to find Submarines" *FM and Television,* May 1946, pp. 22, 23, 24, 48 & 57.

*Primary Examiner*—Trygve M. Blix
*Assistant Examiner*—Thomas J. Brahan
*Attorney, Agent, or Firm*—Birch, Stewart, Kolasch & Birch

[57] ABSTRACT

A life buoy equipped with a radar responder adapted to transmit waves in response to radar waves from a searcher, the life buoy comprising a hull member of a rigid plastic hollow construction, the hull member water-tightly accommodating a receiving antenna, a receiver, a transmitting antenna, a transmitter and a battery in a vertical manner such that the center of gravity is located at a distance from and below the center of buoyancy, and the hull member having a downwardly converging shape from under the level of water at least up to the center of buoyancy.

15 Claims, 6 Drawing Figures

(A)

(B)

LIFE BUOY WITH A RADAR RESPONDER

This application is a continuation of application Ser. No. 571,185 filed on Jan. 16, 1984 and now abandoned.

FIELD OF THE INVENTION

The present invention relates to a life buoy usable by survivors at sea to indicate their position. More particularly, the present invention relates to a life buoy equipped with a radar responder for transmitting signals in response to the interrogation from a searcher whereby the position of the survivors at sea is identified for saving their life.

BACKGROUND OF THE INVENTION

Such a type of buoy, often referred to as a life buoy, is aboard ships or aircrafts for use in an emergency so as to indicate the position of the survivors at sea or in the ocean. The life buoy of this type is equipped with a radar responder designed to have a transponder function, or to transmit respondent radio waves at the reception of radar waves transmitted from the searcher's radar on 9 GHz in common throughout the world. The radar responder transmits respondent radio waves at the same frequency as that of the searcher's radar. When the searcher's radar receives the reply from the responder of a life buoy, a continuous line of glittering dots are displayed on the screen.

To explain the system of the known life buoy more in detail, reference will be made to FIG. 1:

When the searcher's radar receives respondent radar waves 2 from a life buoy, a continuous line of glittering dots 3 are displayed on a screen 1, wherein the screen has a center 4 around which the dots 3 appear. When the life buoy receives the seacher's radar waves, it transmits respondent waves 2 which are swept at a time period of Ts several times in a range $\Delta F$ of 9300 to 9500 MHz. The sweeping signals are received in the receptive band width Br, and are represented as glittering dots or spots 3.

In general, the life buoy must satisfy the following conditions:

(1) Regardless of any weather on the ocean radar waves can be effectively transmitted between the life buoy and the searcher;

(2) Without special techniques for which an official licence is required, the life buoy can be operated with ease;

(3) The life buoy must be compact, strong and inexpensive, without undesirably influencing its stability.

In addition, the life buoy must be maintained such that no failure occurs when an emergency happens. Particularly, special care must be taken not to cause the life buoy to operate when the ship is tossed about in stormy seas. The high pitch and roll of the ship provides a similar condition at which the operation of the life buoy is initiated in the emergency of its shipwreck. Accordingly, the life buoy must be constructed such that it can recognize between an emergency and a non-emergency, and if an emergency occurs, it must be sure to operate automatically when the buoy is thrown into the sea.

It is known in the art to employ a halved outer case for accommodating the responder, wherein the case is dividable by pulling a string coupled to the responder so as to allow the responder to be thrown on the water. This halved type of case is disclosed in Japanese Laid-Open Patent Specification No. 55-154482. It is also known in the art that a floating responder is equipped with an auto-responder adapted to respond to radar waves from a searcher, and additionally with a lamp which the survivor can use as a light for his convenience as well as a beacon for the searcher. This floating responder is disclosed in Japanese Laid-Open Patent Specification No. 55-152483.

OBJECTS AND SUMMARY OF THE INVENTION

An object of the present invention is to provide a life buoy which effects radar wave communication with the searcher's radars regardless of any weather.

Another object of the present invention is to provide a life buoy which is easy to operate by an unlicensed layman, without any special technique and skill.

A further object of the present invention is to provide a life buoy of relatively small dimensions and rigid construction, and which is relatively inexpensive to manufacture but, notwithstanding the small size and the inexpensive cost thereof, is sufficiently stable to perform its operation.

A still further object of the present invention is to provide a life buoy which includes an arrangement allowing instant operation in an emergency, and which does not allow responding to normal oscillating movememts of the ship but allows automatically operating in response to the life buoy landing on the water of the sea in consequence of a shipwreck.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to one aspect of the present invention, there is provided a life buoy equipped with a radar responder adapted to transmit signals in response to an interrogation from a searcher, the life buoy comprising:

a hull member of a rigid plastic hollow construction;

the hull member water-tightly accommodating an antenna, a receiver, a transmitter and a battery in a vertical manner such that the center of gravity is located at a distance from and below the center of buoyancy; and the hull member having a downwardly converging shape from under the level of water at least up to the center of buoyancy.

According to another aspect of the present invention, there is provided a life buoy equipped with a radar responder adapted to transmit signals in response to an interrogation from a searcher, the life buoy comprising:

a hull member of a rigid plastic hollow construction;

the hull member water-tightly accommodating an antenna, a receiver, a transmitter and a battery in a vertical manner such that the center of gravity is located at a distance from and below the center of buoyancy;

the hull member having an upper upwardly converging wall portion above the level of water, and a lower downwardly converging wall portion from under the level of water at least up to the center of buoyancy, wherein the upper upwardly converging wall portion includes a slender straight cylindrical portion formed at the top thereof;

an accommodator for allowing the hull member to be mounted thereon in an upside down posture, the accommodator including a first supporting section in which the upper upwardly converging wall portion of the hull member is supported in linear contact therewith, and a second supporting section in which the top portion of the hull member is retractably supported, thereby ensuring that the life buoy is ready to be released from the accommodator in an emergency but is kept inoperable in a non-emergency.

BRIEF DESCRIPTION OF THE DRAWINGS

FIG. 6 shows a further example of modified version, of which FIG. 6(A) is a perspective view showing a covering member and FIG. 6(B) is a partial cross-section of the whole body of the life buoy.

DETAILED DESCRIPTION OF THE INVENTION

Figure 1:
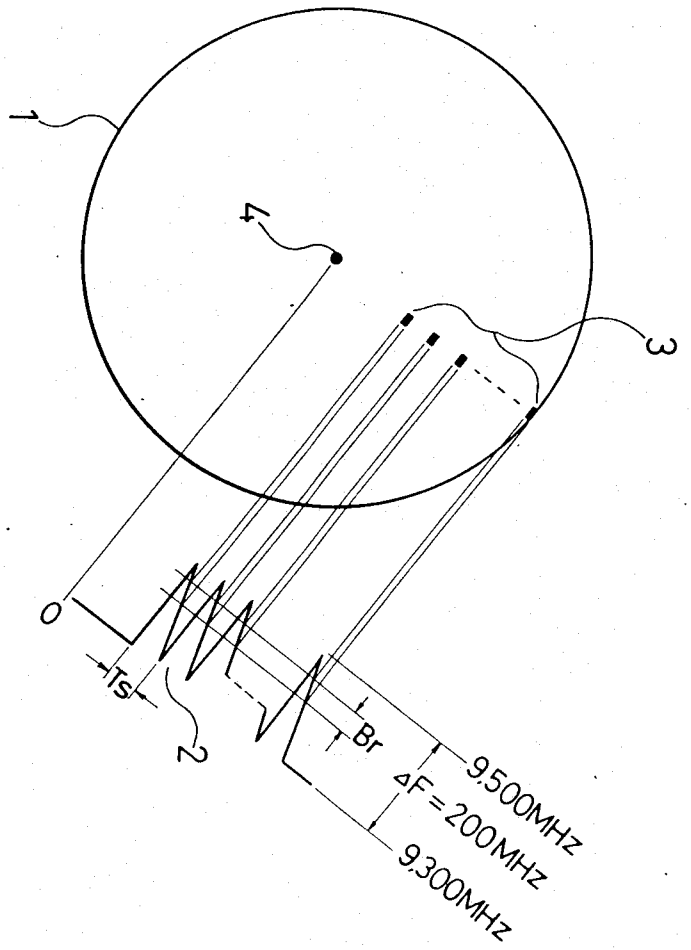
FIG. 1 is a diagrammatic view showing a mode of display on the searcher's radar when the same receives respondent waves from the life buoy.
Figure 2:
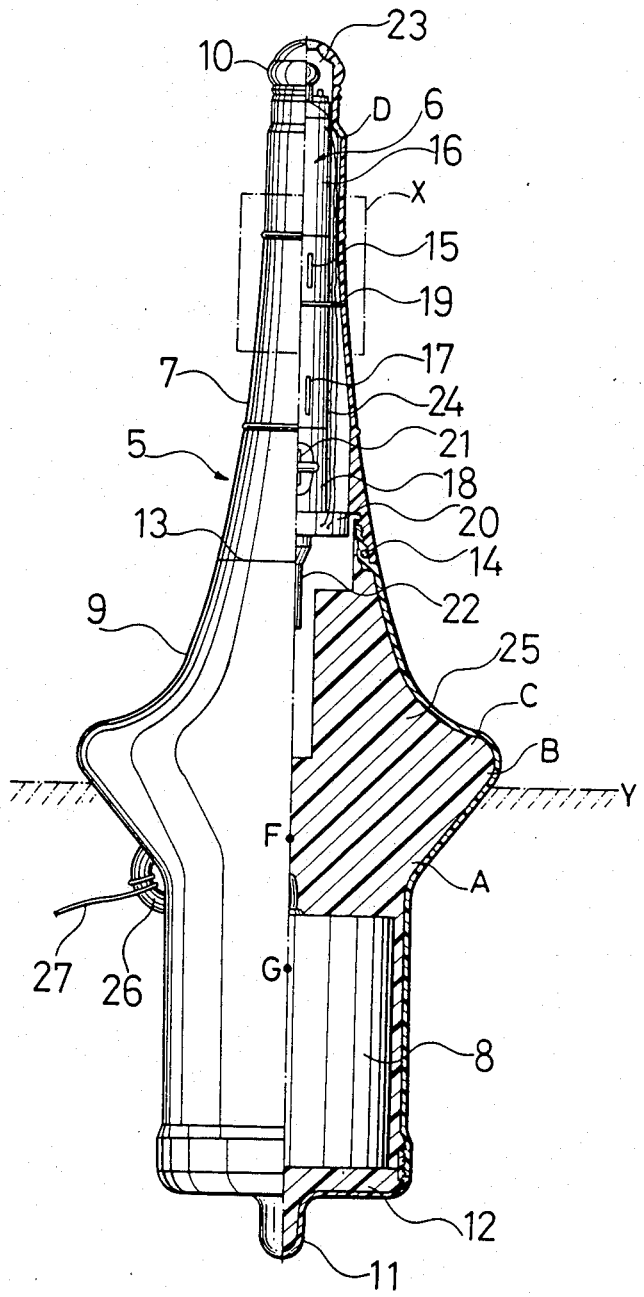
FIG. 2 is a partial cross-section of a life buoy embodying the present invention.

The buoy shown in FIG. 2 includes a hull 5 of a rigid plastic hollow construction, which includes a housing section 7 for accommodating a main body portion 6 and a battery section 9 for storing a battery 8. The housing section 7 is made of plastic by injection, wherein the plastic resin is required to permit passing of light and radio waves. Polycarbonates can be preferably used. The housing section 7 has a transparent top portion 10, which is made to constitute lenses by varying the thickness. The lenses of one piece have focuses in a horizontal, vertical and 45° upward diagonal direction.

The battery section 9 is a rigid hollow construction of polyethylene, and its bottom portion is covered by a lid 12 having a projection 11.

The housing section 7 and the battery section 9 are water-tightly screwed to each other at 13 with the use of an O-ring 14.

The main body portion 6 accommodates a receiving antenna 15, a receiver 16, a transmitting antenna 17, a transmitter 18, and a partition 19 for separating between the receiving antenna 15 and the transmitting antenna 17. The receiving antenna 15 receives radio waves from a searcher's radar and the transmitting antenna 17 transmits signals in response thereto. In addition, the main body portion 6 includes a control section 20, a mercury switch 21, a power supply connector 22 connecting the battery 8 and the main body portion 6, and a display section 23 which includes an indicator lamp and a battery checker. The control section 20 is designed to generate predetermined signals for controlling transmission sent to the transmitter 18 at the reception of signals from the receiver 16, and signals to the indicator lamp. The mercury switch 21 is to open the circuit to the battery 8 when no emergency occurs in which the buoy is standing upside down or laid down on its side, but to close the circuit when the ship is wrecked and the buoy is thrown into the sea and is afloat thereon in use. The indicator lamp is designed to indicate the reception of signals from a seacher, and the battery checker is to indicate the consumption of the battery 8. The control section 20, the transmitter 16 and the display section 23 are connected by a lead wire 24.

The battery 8 is placed in the battery section 9 by removing the lid 12. After the battery 8 is placed, the lid 12 is water-tightly sealed.

The battery section 9 is packed with foamed plastics 25, so as to secure the battery 8 with no gaps therein, and also to provide strength and buoyancy to the battery section 9.

The reference numeral 27 designates a rope for connecting the battery section 9 to a cover 50, hereinafter referred to, which is designed to float on the water while being guyed to the buoy by the rope 27.

It is essential to effect radar wave communication between the life buoy and the searcher in any weather conditions. To this end, a highest possible antenna is desired, which is well known in the art. Therefore, as shown in FIG. 2, the transmitter 18, the receiver 16, the transmitting antenna 17, and the receiving antenna 15 are vertically aligned along the axis of the life buoy. However, this unavoidably results in an unstable tall configuration, in which the buoy tends to decline or sink under wave and wind actions. If the life buoy declines or sinks, the effective height of the antenna is reduced with respect to the level of water. This leads to a bad radar wave communication.

To solve this problem the life buoy of the invention is provided with an arrangement whereby the pitch and roll of the life buoy is minimized and smoothly follows oscillating movements of waves.

The life buoy of the invention has a uniquely shaped underwater portion where the center of gravity (G) is set at a distance from the center of buoyancy (F). This is achieved by considering the weights, the buoyancy and positions of the hull 5, the battery 8 and other components contained in the hull 5. Particularly, the hull 5 is designed to have an expanded shape in the area located above the center of buoyancy (F) up to a little higher point above the water level Y, so as to increase the buoyancy in this area continuously and concentratedly. If the increase in buoyancy is only aimed at so as to secure a good wave-following ability, a proposal can be made for making the housing section cylindrical with a ring-shaped float fixed to its side, whereby buoyancy is concentratedly intensified at a point above the center of buoyancy. However, a buoy of this shape is likely to follow wave movements with a particular decline due to an upward urge acting on the undersurface of the ring-shaped float under strong winds. This causes the antenna beam to be deviated from the direction of a searcher's radar. In addition, the buoy is in danger of separating from the survivor.

The underwater portion of the life buoy of the invention is designed to solve such problems, the details of which are as follows:

Referring to FIG. 2 the underwater portion between the points indicated by the letters A and B is shaped to be expanded or tapered in a downwardly converging form. The tapered side indicated by the letter A is effective to minimize a wind pressure acting thereon when the buoy is declined under a strong wind. On the other hand, when the buoy is forced to sink under a strong wind pressure, buoyancy strongly acts on the tapered side, thereby saving the buoy from sinking under the water.

In the illustrated embodiment, a battery 8 is located in the bottom of the hull 5, thereby ensuring that the center of gravity is located at a required distance from the center of buoyancy. If this is not sufficient, a lead weight can be added to the bottom of the hull 5.

The portion of the buoy above the water level between the points indicated by the letters C and D, is made slender in an upwardly converging form so as to minimize a wind pressure acting thereon. Particularly, the top portion indicated by D is most subjected to a wind pressure because of its height in the body of the buoy, and accordingly, this part is made straight but most slender as a slender straight cylindrical portion. This upwardly converging form is advantageous in that even when the life buoy wholly sinks under water, it is ready to return to the water surface quickly.

For better understanding, a dimensional example of a preferred embodiment will be shown:

The entire length of the life buoy was 590 mm, the maximum outside diameter was 200 mm, and the total weight was 2.7 kg (including a battery weight of 2 kg). The distance between the center of gravity and the center of buoyancy was 50 mm. The outline defined by the line A-B in FIG. 2 is convergent with gradual decreases whereas the outline defined by the line C-D is convergent with an exponential function.

As mentioned above, one of the advantages of the present invention is that the life buoy can be operated by an unlicensed layman with ease and readiness. To achieve it, the life buoy of the invention is specially devised:

In general, there are essential requirements for a layman who is inexperienced in operating the life buoy and unfamiliar with its mechanism. One is that the life buoy is prevented from transmitting erroneous signals when the operator is wrong or makes error in operating the life buoy. Another is that the life buoy never fails to operate in an emergency. To this end the life buoy must be carefully maintained so as to keep its normal condition, and be accessible to regular inspection.

To satisfy the first requirement, the life buoy of the invention is provided with an arrangement by which the battery is switched on only when the buoy floats in its vertical posture, whereas the battery is switched off when the buoy is laid down on its side. This is effected by the mercury switch 21, and in the non-emergencies the buoy is prevented from uprightly standing by the projection 11 provided on the bottom portion thereof, so as to keep the battery inoperative. When an emergency arises, and the life buoy is thrown into the water, it is ready to float in its vertical posture, thereby allowing the same to initiate its signalling work.

Figure 3:
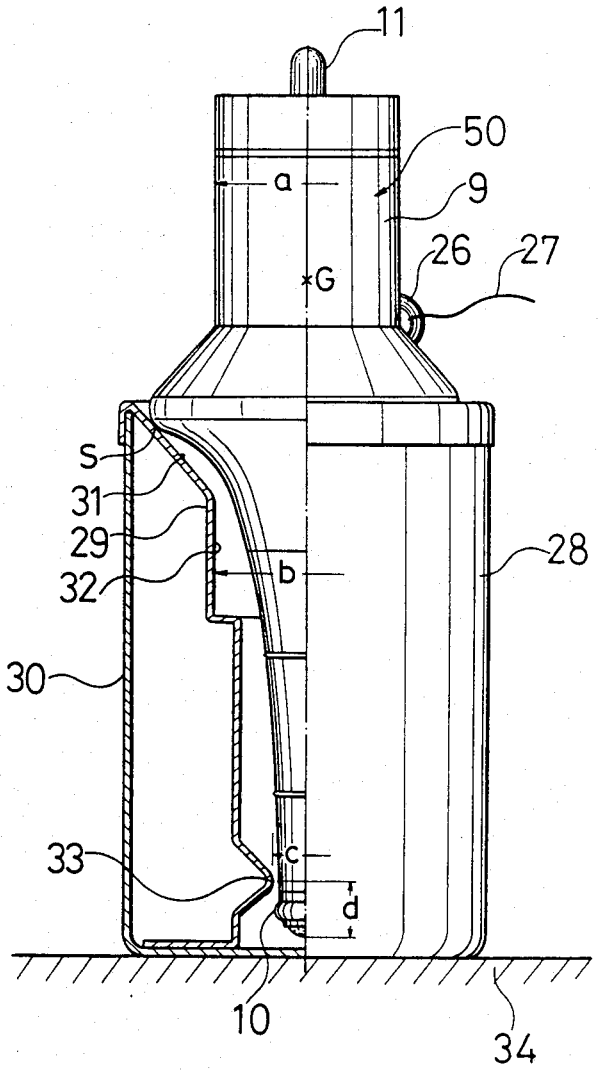
FIG. 3 is a partial cross-section of a modified version of the life buoy.

The life buoy of the invention is placed upside down on a special case, as shown in FIG. 3. When it is carried by hand, the porter tends to hold it at a slender portion of the housing section 7 with the battery section 9 downwards. However, in this posture the battery is switched on in spite of the non-emergency, and the system is ready to generate signals in response to radar waves. In order to prevent such errorneous operation, a handle portion indicated by the letter X is located at the same height as that of the receiving antenna 15 (the handle portion X is shown by the dotted lines). It is generally known that when radar waves pass through the palm of a hand a resulting loss amounts to more that 20 db. When the handle portion X is grasped by hand, radar waves are obstructed by the palm from being received by the receiving antenna 15, thereby keeping the receiver 16 inoperative even when radar waves impinge on life buoy. Thus an errorneous signalling is safely prevented.

When the frequency is 9GHz, the receiving antenna has a slot length of 16 mm, which is fully covered by a palm.

In order to secure the functional stability and reliability, the internal mechanism is protected against damages due to salty wind and water by means of a water-tight construction durable over a long period of use. To this end the internal mechanism is covered by the hull 5 of plastic, in which the main body portion 6 is accomodated in the housing section 7, and the battery 8 and the foamed plastic 25 are accommodated in the battery section 9. As described above, the housing section 7 and the battery section 9 are water-tightly joined by the O-ring 14, thereby unifying these two sections. This way of assembling makes it possible to fabricate the housing section 7 requiring precise dimensions by injection with the use of polycarbonate, and the battery section 9 requiring less precise dimensions by blow molding with the use of polyethylene. In general, the main body portion 6 can be effectively used for five or more years, whereas the life of the battery is a year or so because of its self-discharging. However, by virtue of the readily disassembling construction no trouble arises in replacing the battery section 9 as a whole. Thus the maintenance is very accessible.

To check the discharge of the battery 8, the display section 23 is relied on, in which an indicator lamp and a checker are provided for visual check.

Referring to FIG. 3, in which like reference numerals are used to designate like parts and elements to those in FIG. 2, a modified version of the embodiment will be described:

The reference numeral 28 designates a first supporting member as an accommodator in which the responder 50 is mounted, which includes an inner frame 29 and an outer frame 30 supporting the inner frame 29. The inner frame 29 includes a conical section 31, a cylindrical section 32 and a throat section 33. The portion of the conical section 31 indicated by the letter S is adapted to engage the responder 50, which is inserted in the accommodator 28 with the top portion 10 downwards. The top portion 10 is inserted through the throat section 33 by a distance (d) downwards. The accommodator 28 equipped with the responder 50 is fixedly aboard the ship 34, wherein the center of gravity G of the responder 50 is located above the accommodator 28. The dimensional relationship between the responder 50 and the accommodator 28 is as follows:

The outside diameter (a) of the responder 50 is slightly smaller than the inside diameter (b) of the cylindrical section 32 of the accommodator 28, and the outside diameter of the top portion 10 of the responder 50 is slightly smaller than the inside diameter (c) of the throat section 33.

As evident from FIG. 3, the responder 50 is mounted on the accommodator 28 upside down. The responder 50 is securely mounted in the above-mentioned dimensional relationship, whereby it is protected against a possible displacement or movement under oscillations resulting from wave action. If the ship helplessly declines due to its wreck, the responder 50 is subjected to a centrifugal force at its center of gravity G, wherein the centrifugal force acts on the responder 50 at the G thereby to cause the same to rotate about the center of decline of the ship. Under this rotational urge the responder 50 is released from the accommodator 28, preparing itself for being afloat on the sea.

Figure 4:
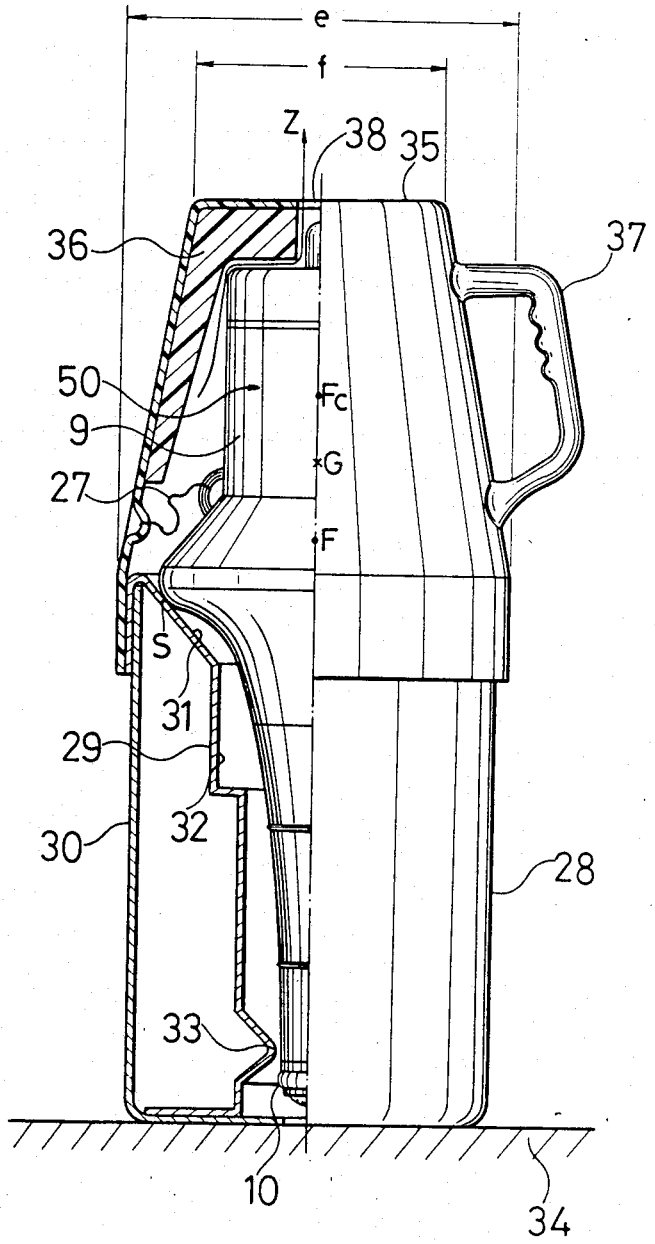
FIG. 4 is a partial cross-section of another modified version.

FIG. 4 shows a further example of the embodiment, in which a sunshade is additionally provided. As well known, a battery tends to discharge when its temperature rises under sunshine. This happens in the life buoy of the invention, and to avoid self-discharging of the battery 8, an additional cover 35 is provided to cover the responder 50. In FIG. 4 like reference numerals are used to designate like parts and elements to those in FIGS. 2 and 3. The cover 35 is made of polyethylene by blow molding, with a packing material 36 inside, such as foamed urethane. The cover 35 is provided with a handle 37.

Under the shade provided by the cover 35 packed with the insulating material 36, and additionally owing to a vent 38 provided in the top portion of the cover 35, the battery 8 is protected against a detrimental build-up of heat in the battery section 9. This minimizes self-discharging of the battery due to the build-up of heat inside.

The cover 35 has a tapered shape, that is, the diameter of the top (f) is made smaller than that of the bottom portion (e). Owing to this shape the cover 35 is pressed on the responder 50 under strong winds, thereby preventing the same from being blown away. The cover 35 is connected to the responder 50 by a rope 27. When the responder 50 is released from the accommodator 28 under the centrifugal action, the cover 35 is pushed up by the responder 50, and is detached from the accommodator 28. In the course of falling onto the water, shocks are absorbed by the packing material 36 in the cover 35, and when the responder 50 is thrown thereon, it is afloat separately from the cover 35 because they have their own centers of buoyancy at spaced points F and Fc. They are independently adrift, but are connected to each other by the rope 27. The cover 35 is used as a life-saving float. The length of the rope 27 is such as to allow the survivors to see the top portion 10 of the responder 50 shining, and not to allow the survivors to obstruct radar wave communications by the responder 50 under their shadow. It has been found that an optimum length is 3 m. In FIG. 4 the letter Z shows the direction in which air is allowed to vent.

Figure 5:
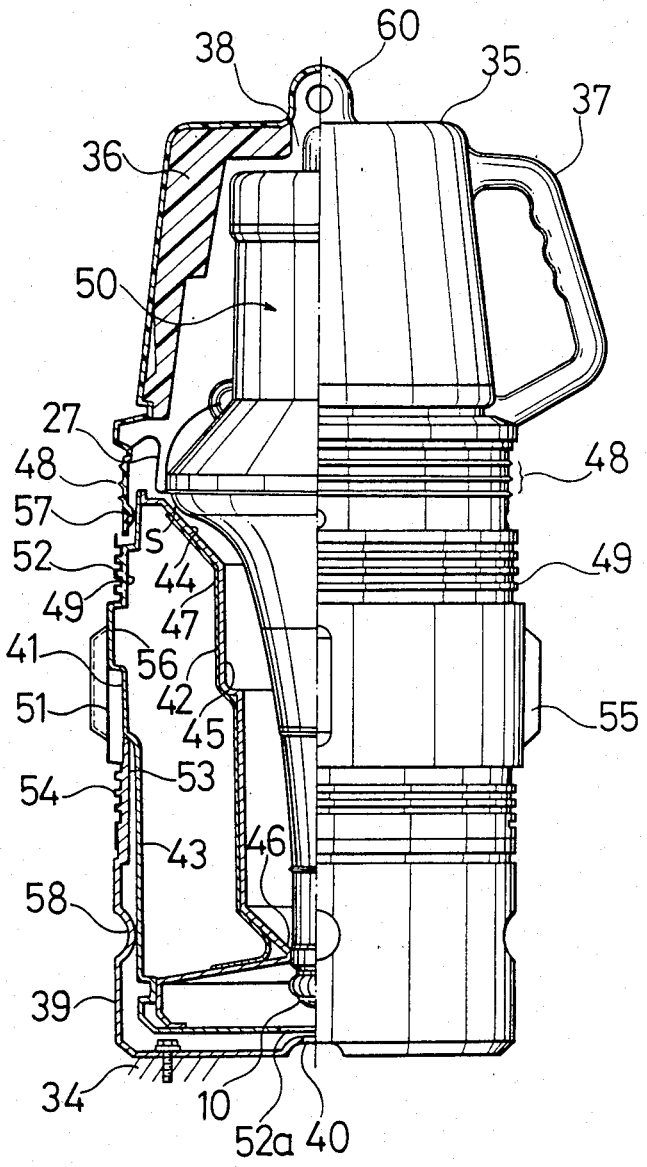
FIG. 5 is a partial cross-section of another example of a modified version.

FIG. 5 shows another modified version of the embodiment, in which the like reference numerals are used to designate like parts and elements to those in FIGS. 2, 3 and 4. This embodiment is characterized in that an accommodator 41 can be used as a second supporting member such as a portable case. The accommodator 41 is placed on a rack 39 fixed to the ship 34, such as on the deck. The rack 39 is provided with a vent 40 at its bottom. The accommodator 41 includes an inner frame 42 and an outer frame 43, and the inner frame 42 includes a conical section 44, a cylindrical section 45 and a throat section 46. The reference numeral 47 designates an electromagnetic shield, whereby the transmitter and receiver sections of the responder 50 are shielded from the outside. The cover 35 is provided with threads 48 on its outside wall, and the accommodator 41 is provided with threads 49. The rack 39 is provided with threads 53. A coupling ring 51 is provided with threads 52, 54, which respectively correspond to the threads 48, 49 and 53.

When threads 48 and 49, and 52 and 54 are screwed thereby to unite the cover 35 with the accommodator 41, the whole body can be carried by holding the handle 37 by hand. While the body is being held upside down, the lamp and battery checker located in the top portion 10 can be watched through an opening **52*a* produced in the bottom of the accommodator 41. When the threads 53 and 49, and 52 and 54 are screwed thereby to unite the rack 39 with the accommodator 41 the responder 50 is safely shielded by the cover 35 in similar way as shown in FIG. 4. The reference numeral 55 designates a projection whereby the coupling ring 51 is rotated by hand, and the reference numeral 56 designates a projection produced on the outer frame 43 so as to limit the rotation of the coupling ring 51. The cover 35 is provided with tongue members 57 at four spaced points on its periphery, whereby the cover 35 is secured to the accommodator 41. Similarly, the rack 39 is provided with four tongue members 58, whereby the rack 39 is secured to the accommodator 41. The rack 39 includes a vent 40** at its bottom.

When the coupling ring 51 is lowered by rotating the same by means of the projection 55, the whole body rests on the accommodator 41, whereas when the coupling ring 51 is raised, the whole body is ready to be portable. When it is in the portable but upside-down state, the mercury switch 21 in the responder 50 is turned on, which is observed by seeing the battery checker through the transparent top portion 10. The check is accessible to the user, thereby allowing any failure or error to be readily watched. The electromagnetic shield 47 prevents erroneous signalling possibly resulting from the upside-down posture of the responder 50 wrongly taken by the porter. This is due to the fact that the electromagnetic shield 47 protects the responder 50 against radar waves impinging thereon when there is no need for it.

Figure 6:
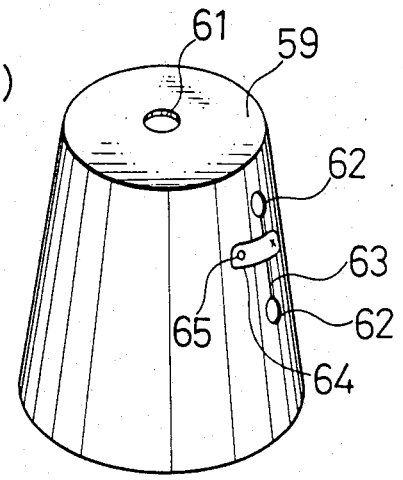
Figure 6:
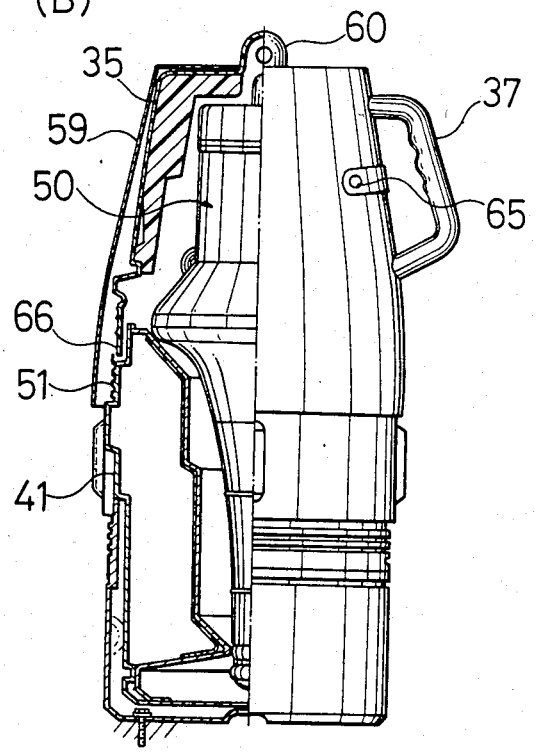

FIG. 6 shows a further modified version of the embodiment, in which the reference numerals are used to designate like parts and elements to those in FIGS. 2, 3, 4 and 5. This embodiment is characterized in that a hat 59 is provided for protecting the interior mechanism against becoming frozen, wherein the hat 59 is overlaid on the cover 35.

The hat 59 is made of relatively thin cloth, which does not permit water drops to be frozen thereon. A polyester fabric, such as Tetron, can be used. As shown in FIG. 6 (A), the hat 59 is provided with a hole 61 in its top, and two holes 62, which are connected by a slit 63. The hole 61 is designed to accept the projection 60 of the cover 35, and the two holes 62 and the slit 63 are designed to accept the handle 37 thereof. The slit 63 is normally closed by a strap 64, which is fastened to the hat 59 by means of a suitable fastener, such as a hook or button.

The hat 59 is intended to prevent water drops staying on the buoy body from freezing. Water drops are likely to concentrate in the gaps 66 around the coupling ring 51, and if freezing occurs in this area, the responder 50 and the cover 35 are difficult to be released from the accommodator 41. To this end the hat 59 is made sufficiently long to cover the gaps 66. In addition, the hat 59 has a slightly larger diameter than those of the cover 35 and coupling ring 51, thereby allowing its loose lower part to flap in the wind. Owing to the flapping movement of the hat 59 sticking ice is blown off, thereby preventing the cover 35 from being frozen to the accommodator 41. Optionally, the hat 59 is coated with aluminium on its outside surface, thereby strengthening its insulating ability. The same effect results when an aluminium-coated fabric is used to fabricate the hat 59. This type of hat is especially useful when the buoy is placed under a highly luminous fish-luring light in a fishing boat, which light usually has a surfacial temperature of more than 300° C. Such a high temperature undesirably influences the responder 50, and it is particularly effective to use a hat of intensified insulating nature.

As evident from the foregoing description, according to the present invention the life buoy has a unique structure in which gravity and bouyancy are taken into consideration in light of oscillating movements under wave actions and wind pressure. As a result, the life buoy of the invention well follows waves, and is afloat with a minimum decline in strong winds. This secures radar wave communications between the life buoy and the searcher. In addition, the life buoy is protected against erroneously signalling when no emergency happens; erroneous signalling would occur when the buoy oscillates under usual wave actions. Furthermore, the buoy is sure to be put into operation when the ship is wrecked, which is distinguished from a mere oscillating movement under wave actions.

What is claimed is:

1. A life buoy equipped with a radar responder adapted to transmit signals in response to an interrogation from a searcher, the life buoy comprising:

a hull member of a rigid plastic hollow construction;

said hull member water-tightly accommodating a receiver, a receiving antenna, a transmitting antenna, a transmitter and a battery in a vertical manner from the top to the base of said hull respectively, wherein the center of gravity is located at a distance from and below the center of buoyancy when said buoy is in an upright floating orientation;

said hull member having an upper upwardly converging wall portion above the level of water including a slender straight cylindrical portion formed at the top thereof, and a lower downwardly converging wall portion from the water level at least down to the center of buoyancy, said hull member thereby having food wave following ability; and an accommodator for releasably supporting the upper upwardly converging portion of said hull member in an upside-down non-floating posture, said accommodator including:

an inner frame having a conical section, a cylindrical section, and a throat section such that said upper upwardly converging portion of said hull member substantially conforms to said inner frame, and an outer frame having a substantially cylindrical wall member wherein said wall member is integrally formed with a base at the lower end thereof and wherein said wall member supports the conical section of said inner frame thereby forming said accommodator.

2. A life buoy as set forth in claim 1, further including a switch located within said upper upwardly converging portion and a projection provided on the outside bottom of said hull member, the switch being turned on when the buoy is in an upright posture and the switch being turned off when the buoy is in a horizontal posture.

3. A lie buoy as set forth in claim 1, wherein said hull member includes an upper section and a lower section partitioned at a point located within said upper upwardly converging wall portion, said upper and lower sections being water-tightly screwed to each other.

4. A life buoy according to claim 1, wherein said slender straight cylindrical portion formed at the top of said upper upwardly converging portion housing said receiving antenna.

5. A life buoy according to claim 4, wherein said slender straight cylindrical portion acts as a carrying handle when said buoy is in an upright non-floating orientation, said receiving antenna prevented from being an effective warning device by a users hand being wrapped there around in a carrying position.

6. A life buoy as set forth in claim 1 wherein said accommodator is provided with an electro-magnetic shield in said inner and outer frames.

7. A life buoy as set forth in claim 1, further comprising a covering for covering the underwater portion of saidhull member when said life buoy is inserted in an upside-down orientation in said accommodator, thereby protecting the internal mechanism of said life buoy contained therein against outside heat.

8. A life buoy as set forth in claim 7, wherein said covering is packed with foamed plastic.

9. A life buoy as set forth in claim 7, wherein said accommodator is provided with an electromagnetic shiled in said inner and outer frames.

10. A life buoy as set forth in claim 7 further comprising a second covering of a pliable material capable of yielding in wind, said second covering being overlaid on said first covering.

11. A life buoy as set forth in claim 7, further including a plurality of ribs formed around the periphery of said outer frame of said accommodator and a plurality of ribs formed around a portion of said covering.

12. A life buoy as set forth in claim 11, further including a rack for supporting said accomodator, wherein said rack is attachable to the surface of a boat deck or the like and whose inner surface substantially conforms to the outer circumferential surface area of said outer frame and whose outer surface contains a plurality of concentric ribs.

13. A life buoy as set forth in claim 12, further including a coupling ring having a plurality of ribs formed on the inner periphery thereof, at least a portion of said plurality of ribs of said rack and said accommodator coacting with said plurality of ribs of said coupling ring for securing said accommodator to said rack.

14. A life buoy as set forth in claim 12, wherein said accomodator is provided with an electromagnetic shield in said inner and outer frames.

15. A life buoy as set forth in claim 7, further including a second hat shaped covering of a pliable material capable of easily yielding in wind, said second hat shaped covering conforming to and being overlaid on said first covering.

* * * * *